United States Patent [19]

Raber et al.

[11] Patent Number: 4,791,427

[45] Date of Patent: Dec. 13, 1988

[54] MULTIMODE, MULTISPECTRAL ANTENNA

[75] Inventors: Peter E. Raber, Milford; Lester H. Kosowsky, Stamford, both of Conn.

[73] Assignee: United Technologies Corporation, Hartford, Conn.

[21] Appl. No.: 800,938

[22] Filed: Nov. 22, 1985

[51] Int. Cl.[4] ..... H01Q 21/28

[52] U.S. Cl. ..... 343/754; 343/725

[58] Field of Search ..... 343/725, 753, 754, 757, 343/815, 909, 912, 781 P, 911 R

[56] References Cited

U.S. PATENT DOCUMENTS

| | | | |
|---|---|---|---|
| 2,530,580 | 11/1950 | Lindenblad | 343/100 |
| 2,599,864 | 6/1952 | Robertson et al. | 250/33.63 |
| 2,887,684 | 5/1959 | Dexter et al. | 343/781 P |
| 2,975,419 | 3/1961 | Brown | 343/754 |
| 3,146,451 | 8/1964 | Sternberg | 343/753 |
| 3,170,158 | 2/1965 | Rotman | 343/100 |
| 3,189,907 | 6/1965 | Buskirk | 343/753 |
| 3,255,453 | 6/1966 | Horst | 343/911 R |
| 3,287,728 | 11/1966 | Atlas | 343/753 |
| 3,688,311 | 8/1972 | Salmon | 343/755 |
| 3,979,755 | 9/1976 | Sandoz et al. | 343/754 |
| 4,282,527 | 8/1981 | Winderman et al. | 343/725 |
| 4,309,710 | 1/1982 | Cassel | 343/754 |
| 4,480,254 | 10/1984 | Spencer et al. | 343/708 |
| 4,636,797 | 1/1987 | Sandoz et al. | 343/725 |
| 4,642,651 | 2/1987 | Kuhn | 343/754 |
| 4,652,885 | 3/1987 | Sandoz et al. | 343/725 |

FOREIGN PATENT DOCUMENTS

| | | | |
|---|---|---|---|
| 2738549 | 3/1979 | Fed. Rep. of Germany | 343/754 |
| 53-27347 | 3/1978 | Japan | 343/753 |
| 54-132156 | 10/1979 | Japan | 343/753 |

*Primary Examiner*—William L. Sikes
*Assistant Examiner*—Doris J. Johnson

[57] ABSTRACT

A multimode, multispectral antenna system (14) for detecting radiation from selected target regions in each of at least a pair of selected spectrum bandwidths through collimating lens (35), and rotatable, cooperative prisms (21) effective for collimating and scanning beams of radiation controllably with respect to said target regions.

2 Claims, 1 Drawing Sheet

MULTIMODE, MULTISPECTRAL ANTENNA

CROSS REFERENCE TO RELATED APPLICATIONS

The subject matter of this application is related to the subject matter of commonly owned U.S. patent application Ser. No. 800,937 filed on even date herewith and bearing the same title as the herein invention.

TECHNICAL FIELD

This invention is directed toward the technical field of electromagnetic antennas and particularly toward radar antenna for detecting energy in selected portions of the electromagnetic spectrum from a target region under observation.

BACKGROUND ART

Typical radar, electromagnetic detection and/or surveillance schemes of the past and present have employed only a single band or a single range of electromagnetic energy bands.

Such systems are typically complex. This tends to discourage the development of schemes and systems operating in more than a single range or a single set of bands of electromagnetic energy.

Prior art millimeter radar systems further typically operate with only one feed at the focal point of an antenna. For purposes herein, a feed is generally considered to be a source of electromagnetic radiation capable of receiving the same. Exceptions to this approach are known, (e.g., phased arrays, Luneberg lens antennas, multiple or extended feeds, etc.), but they are generally either very expensive or they result in degraded performance.

On Feb. 27, 1984, however, the Applicant herein applied for a patent ("Wide Angle Multi-Mode Antenna," Ser. No. 584,273) on a radar antenna which did utilize two separate feeds in a common aperture arrangement operating at about 95 GHz. This system permits the operation of the antenna with each beam independently, or in concert.

Using two kinds of beams operating in the same frequency range provides enhanced operational flexibility. However, such a system remains subject to diffraction, a fundamental resolution limitation. This diffraction in any such system remains directly proportional to the operating wavelength, thereby limiting the resolution of microwave and millimeter wave systems.

Thus, the resolution attainable with millimeter radar, while better than that with lower frequency radar, still remains several orders of magnitude coarser than attainable with infrared systems operating in either the 3–5 micrometer or the 8–12 micrometer wavelength region. These regions are often chosen for infrared systems because the Earth's atmosphere is relatively transparent. Furthermore, infrared systems can operate passively, i.e., they do not need to flood a target actively with radiation in order to observe the reflected energy, as do radar systems. Rather, passive infrared systems detect heat energy which is directly emitted by the target. This passive operation offers concealment during military operations, and is not susceptible to radar jamming techniques.

On the other hand, infrared sensors cannot replace the function of radar; rather, radar and infrared systems complement each other, For example, infrared radiation can be attenuated to unusable levels by clouds, fog, rain, snow, etc. while radar can operate effectively in such weather. In addition, many target/background combinations appear significantly different when viewed in different regions of the electromagnetic spectrum. Some targets are therefore more easily detectable in one region than another. Furthermore, information received in two or more spectral regions can often aid in identification and recognition of a potential target, rather than simply in detection. Thus, the use of several types of sensors in conjunction with each other can yield a much higher probability of mission success under a greater variety of circumstances than can the use of one mode or kind of detector operating individually.

Since space is always at a premium in packaging electromagnetic detection systems, particularly when the system is packaged in a missile, it is often impractical to consider the inclusion of separate sensors in a weapon delivery system. Separate optics, antennas and/or scanning systems would also undesirably result in high cost and weight.

Accordingly, it is an object of this invention to develop a multimode antenna for millimeter radar including an infrared sensor, both detectors utilizing a common aperture system.

It is further object of the invention to establish an electromagnetic scanning system which uses rotating prisms to direct the view of the detection system to selected target regions, said prisms being transparent to all modes of electromagnetic energy used in the antenna.

SUMMARY OF THE INVENTION

Accordingly, the invention herein is directed toward a multimode electromagnetic antenna arrangement operable and effective at several spectral bandwidths or frequencies, which employs the same collimating lens and rotatable prism scanning system for operation at all modes of operation.

According to a preferred embodiment of the invention, one of the spectral bandwidths includes a passive mode of operation employing infrared radiation.

According to a version of the invention, an additional beam focusing feature is interposed between the collimating lens and the passive or infrared detector in order to establish the position of said passive detector at a common focal region with the active radar system source.

Other features and advantages will be apparent from the specification and claims and from the accompanying drawings which illustrate an embodiment of the invention.

BEST MODE FOR CARRYING OUT THE INVENTION

Figure 1:
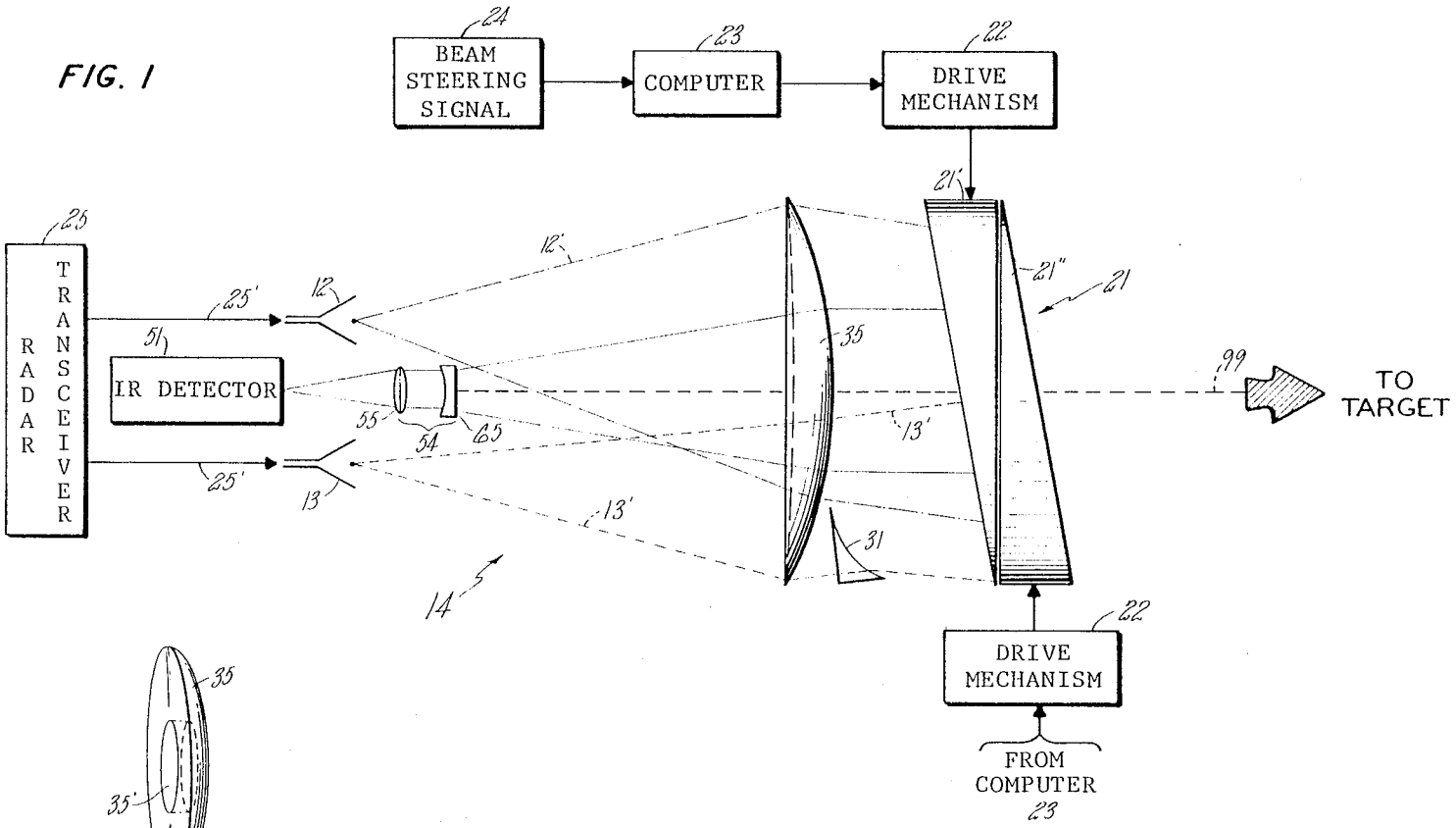
FIG. 1 is a side schematic in partial cross section of a multimode antenna system according to the invention addressed herein.

FIG. 1 shows feeds respectively 12 and 13 for sending and receiving actively derived electromagnetic signals for transmission to and return from selected target regions (suggested, but not shown) generally to the right of the apparatus shown in the drawing. These feeds 12 and 13 operate in a multimode/multispectral detection system 14 according to the invention disclosed herein. The system 14 is considered multimode in that several different beams are received and/or transmitted by the system for detection and processing, and is multispectral in that at least two regions of the electromagnetic spectrum are utilized.

The version of the invention set forth in detail herein deals primarily with the notion of active and passive beams of radiation. However, the embodiment disclosed additionally covers the employment of two modes of active radiation.

Active feeds 12 and 13 of the multimode system 14 may each, for example, be horn type electromagnetic feeds or broad band signal antennas, respectively leading to waveguides 25' carrying the selected electromagnetic energy to the horn of feeds 12 and 13 from a suitable source such as radar transceiver 25.

Feeds 12 and 13 are set transversely apart from another, preferably in a vertical manner in this instance. According to a preferred version of the invention, feed 12 is effective for producing a narrow, pencil beam 12' of radiation. This beam 12' expands until it reaches collimating lens 35 which is a converging lens made of a single kind of material or several materials, as will be seen below.

Feed 13, on the other hand, is effective for producing a broader beam of radiation, which can be and is frequently referred to as a fan beam 13'. The beam 13' "fans out" in response to the broadening action of lens 31, as discussed in greater detail below. The fan beam 13' is typically used for general surveillance, and the pencil beam is effective for tracking and homing purposes once a target has been detected or "acquired".

The pencil beam 12' is focused by collimating lens 35 for direction through rotatable scanning prism assembly 21. The fan beam 13' is also focused by the collimating lens 19, and is then further shaped by a shaping lens 31 which is generally cylindrical, before further direction through the scanning assembly 21.

U.S. patent application Ser. No. 584,273, filed Feb. 27, 1984, shows preferred modes for carrying out portions of the structure of the overall system herein addressed insofar as it relates to the establishment of multiple active beams and the hardware related thereto. The inventors in that case are Peter E. Raber and John H. Cross. The title of the Application is "Wide Angle Multi-Mode Antenna". The contents of the Application are hereby expressly referred to and incorporated herein.

The beams 12' and 13' generated are directed toward selected target regions by a rotating prism assembly 21 after being collimated by collimating lens 35. This assembly 21 includes first and second cylindrical prisms respectively 21' and 21'', which are rotatable about axis 99 coincident with the cylindrical axes of the prisms 21' and 21'' extending toward the selected target region. Prisms 21' and 21'' both rotate in the same direction at selected speeds, or in opposite directions, or one of them can be stationary. This effects the scanning or direction of beams of radiation in specific predetermined or preselected directions, without reliance upon cumbersome, complicated and expensive mechanical arrangements such as gimbal devices, for example, which are relatively unreliable and frequently prone to breakdown. Instead, a simple rotary drive mechanism 22, employing gears, belts, or friction means, for example, to rotate or counter-rotate prisms 21' and 21'' can be employed. Such mechanisms 22 can conveniently be purchased commercially from any one of a number of vendors, or they can be custom designed according to well-known techniques from available parts and subsystems.

In the passive mode of operation, the multimode system 14 includes, for example, an infrared or video detector 51. Interposed between the detector 51 and the collimating lens 19 is a focusing system 54 which can, for example, include respectively an infrared lens 55 and an infrared beam expander 65.

The infrared energy need not pass through a multiple element focusing system 54. The focusing system 54 may comprise a single component accomplishing both of the purposes of establishing a collimated beam from the converging return beam passing through collimating lens 35, and further focusing the beam to a desired focal point or region at which the IR detector is effective for detection.

This focusing system permits the establishment of detection means for each mode of operation at the same general focal region. In other words, the IR detector 51 can be co-located in the same general area with feeds 12 and 13, which of course act as detectors also, in conducting reception of radiation in their respective modes.

Regarding the materials used, the collimating lens 35 can be made entirely of a single selected material, a cross-linked polystyrene material, such as Rexolite, for example, which is transmissive to both millimeter wavelength and visible or near infrared radiation. Rexolite, however, has mediocre resistance to abrasion, heat and weathering. Accordingly, other materials may be chosen for their transmission and structural characteristics in the frequency bands of interest. For example, zinc sulfide and zinc selenide are preferred materials at multimeter wavelengths and in both the 3–5 micrometer and the 8–12 micrometer infrared wavelength regions.

The collimating lens 35 is made of a dielectric material, such as Rexolite according to one embodiment. In that instance, one side of the lens is preferably ellipsoidally convex and spherically concave. For Rexolite, the spherical concave surface is approximately flat—the sphere being very large in effect.

Figure 2:
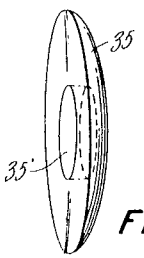
FIG. 2 shows a bi-modal lens used in said antenna system according to another inventive scheme for operation in multimode detection systems.

Since the system 14 operates in multiple modes, in particular, modes involving substantially different frequency or wavelength bands or portions of the electromagnetic spectrum, it is frequently useful to use one kind of material for central portion 35' of the collimating lens 35, and another for the perimeter portion 35'' of the lens 35, as suggested in both figures, but most effectively in FIG. 2. When this is done, the materials may each effectively be chosen to be opaque to the region to which the other is transparent, in order to avoid interference.

By way of further detail, the scanning prism arrangement 21 shown in FIG. 1 comprises two cooperative prisms, respectively 21' and 21'', each of which is bounded by a cylindrical perimeter centered on the rotation axis 99. Each prism is shaped like a wedge having a base and apex when viewed from the side. As shown, the apex of one prism 21' points downward and the apex of the other 21'' points upward. This wedge shape causes each prism to have a circular face and an elliptical face.

The circular faces of the respective prisms are preferably maintained adjacent and parallel to one another, and rotate in a plane perpendicular to the axis 99 of the system. This changes the disposition of the elliptical faces (i.e., hypotenuse) of the prisms and modifies the direction of beams of electromagnetic energy passing through the arrangement.

With the prisms rotated, as shown in the drawing, a beam of radiation passing through the scanning prisms would be passed without net angular redirection, albeit subject to some transverse displacement which, however, has no bearing upon system operation nor on the accuracy of detected signals.

If either of the bases of the prisms 21 is rotated toward the viewer, however, the beam for each mode of energy received or transmitted is redirected somewhat toward the viewer as well. If only one of the bases is rotated, a net downward or upward redirection will also be effected.

To produce exclusively sideward beam sweeping without any upward or downward redirection, the prisms are counter-rotated in coordination with each other, the maximum beam sweep being accomplished when both of the prism apexes are directed toward the viewer or away from the viewer.

Exclusively upward or downward sweeping can be established by rotating both prisms 21 about the axis 90 degrees, and then equivalently counter rotating.

By rotating both prisms 21 in the same direction at the same angular velocity, with any desired initial relative orientation, a conical beam sweep is established.

Spiral, rosette, and other scan patterns can be established by rotating the prisms 21 at different angular velocities in the same or opposite direction even without angular acceleration. Materials such as zinc selenide and zinc sulfide are suitable for the collimating lens 35 and the prisms 21' and 21'', since they are transmissive to millimeter wave infrared, and even visible radiation. Furthermore, they are much more resistant than Rexolite to temperature abrasion and weathering.

Sapphire (i.e., crystalline alumina) is suitable for some applications of the system disclosed, but not for the 8–12 micrometer region, and not for applications in which the fan and pencil beams are polarized, because sapphire is by its nature birefringent and thus has a different effect upon each component of the polarized beam, creating undesired effects for which compensation is difficult to achieve. Sapphire is, however, particularly resistant to abrasion, weathering and adverse temperature conditions.

Polycrystalline ceramic alumina material, which can be used for millimeter wavelength applications, is unfortunately not effective for multimode active and passive arrangements addressed herein, because the material is simply not infrared transmissive. However, in transparent "glassy" form, alumina would be as suitable as sapphire environmentally, without the birefringence problems of the latter. Such a form is provided by formulations based on alumina, such as aluminum oxynitride (ALON) and magnesium aluminate spinel ($MgAl_2O_4$).

It is thought and believed that the material of choice will be gallium arsenide, when it becomes available in large enough sizes, because it is infrared and millimeter wave transmissive and holds up well under adverse temperature conditions.

Transmission of radiation herein is understood in two senses, depending upon context. In one sense, the system 14 actively transmits radiation in one or more spectral bands. Reflected portions of said radiation are transmitted back as well—even though this is not truly transmission, but reception. Similarly, when radiation passes through a prism or lens, it is said to be transmitted therethrough, even though system-wise the radiation may in fact actually be received radiation returning from a target.

The information herein is likely to lead individuals skilled in the art of the invention to conceive of variations thereof which nonetheless lie within the scope thereof. Accordingly, attention to the claims which follow is invited, as these alone specify with authority and legal effect what the scope and impact of the invention actually is.

We claim:

1. A multimode detection arrangement for the detection of remote targets electromagnetically, comprising an active feed for transceiving electromagnetic radiation of a first selected radar spectrum bandwidth, said feed being effective for actively sourcing said radiation and receiving reflected portions of the actively sourced radiation, and refractive collimating lens means, having a collimating lens diameter, for directing and collimating radiation in said first selected radar spectrum bandwidth from said feed toward the region of said targets, wherein said arrangement further includes a detection means for detection of radiation from said targets at a second selected infrared spectrum bandwidth, said collimating lens being substantially transmissive to both of the spectrum bandwidths defining said forms of radiation; and wherein said arrangement includes a second refractive lens means disposed between said detection means and said collimating lens and substantially transmissive to radiation of said second selected infrared spectrum bandwidth and shaped and positioned to focus radiation in said second bandwidth on said detection means, and characterized in that:

said collimating lens means is disposed on a lens axis and said active feed and said detection means are disposed along said lens axis at substantially the same position and displaced transversely from said lens axis by first and second predetermined amounts, respectively, whereby radiation focused by said collimating lens means or by said second refractive lens means into said active feed and said detection means makes corresponding first and second radiation angles with respect to said lens axis and at least one of said corresponding radiation angles is non-zero;

said arrangement includes a mechanically rotatable dual-wedge optical beam steering means having a steering means diameter substantially equal to said collimating lens diameter and having first and second rotatable wedge prisms, centered on said lens axis and controllable, under stored program control, to direct radiation from a predetermined location having a predetermined polar and azimuthal angular orientation with respect to said lens axis, into one of said active feed and said detection means, said first and second rotatable wedge prisms being transmissive to radiation in both said first and second spectrum bandwidths and independently rotatable by mechanical rotation means about said lens axis, whereby said beam steering means may selectively steer radar radiation from a predetermined angular position into said active feed by assuming a first predetermined angular configuration dependent on said radar spectrum bandwidth and said predetermined angular position and may steer infrared radiation from said predetermined angular position into said detection means by assuming a second predetermined angular configuration dependent on said infrared spectrum bandwidth and said predetermined angular position, thereby obtaining information about an object at said predetermined angular position in both the infrared and radar spectral regions.

2. The arrangement of claim 1, wherein said collimating lens is substantially constructed of a material selected from the group consisting of gallium arsenide, zinc sulfide, zinc selenide, aluminum oxide, silicon dioxide and polystyrene.

* * * * *